United States Patent [19]

Rawson

[11] Patent Number: 4,602,582

[45] Date of Patent: Jul. 29, 1986

[54] MONITORING LOOPER THREAD FEED MONITORING DEVICE IN A SEWING MACHINE

[75] Inventor: James W. Rawson, Nottingham, United Kingdom

[73] Assignee: El-Sew-Con Limited, Nottingham, England

[21] Appl. No.: 581,257

[22] Filed: Feb. 17, 1984

[30] Foreign Application Priority Data

Feb. 18, 1983 [GB] United Kingdom ..... 8304579

[51] Int. Cl.[4] ..... D05B 69/36

[52] U.S. Cl. ..... 112/278; 112/273

[58] Field of Search ..... 112/273, 278; 340/677; 250/561, 571; 139/273 A

[56] References Cited

U.S. PATENT DOCUMENTS

| | | | |
|---|---|---|---|
| 3,599,586 | 8/1971 | Newman | 112/278 |
| 4,188,902 | 2/1980 | Kahan | 112/278 |
| 4,333,411 | 6/1982 | Lerner | 112/278 |
| 4,429,651 | 2/1984 | Tajima | 112/273 |
| 4,432,297 | 2/1984 | Kemmel | 112/278 |

*Primary Examiner*—Peter Nerbun

*Attorney, Agent, or Firm*—Christie, Parker & Hale

[57] ABSTRACT

A thread monitor device for a textile machine to monitor thread feed through a region of a machine, the device including a source of light, means to convey the light to a thread feed region, and to direct light into said region, means to receive light directed into said region from said source and produce a monitor signal representative of said received light, means responsive to said monitor signal and to changes therein to indicate the occurrence of a change in said signal representative of a change in thread feed in the region.

10 Claims, 4 Drawing Figures

MONITORING LOOPER THREAD FEED MONITORING DEVICE IN A SEWING MACHINE

This invention relates to the monitoring of the operation of textile machines. The term textile machine includes both textile making machines such as looms and textile processing machines such as sewing machines.

In a textile machine, thread, yarn or other filamentary material is often fed through the machine.

It is most important that any break or other disturbance of the feed of the thread is detected so that the proper feeding of the thread can be resumed. As textile machine speeds increase the need for rapid and reliable detection increases, to avoid waste of material and machine time. Also as machines become more complicated the space available for thread monitoring devices is reduced and mechanical devices as used hitherto become less suitable.

It is an object of the present invention to provide an improved thread monitor device suitable for use in a confined space.

According to the invention there is provided a thread monitor device for a textile machine to monitor thread feed through a region of the machine including a source of light, means to convey the light to a thread feed region, and to direct light into said region, means to receive light directed into said region from said source and produce a monitor signal representative of said received light, means responsive to said monitor signal and to changes therein to indicate the occurrence of a change in said signal representative of a change in thread feed in the region.

The means to convey and direct light may be fiber optic element, having an inclined end face to direct light from the side of the element. Such a fiber optic element may be shaped to focus light directed from the side of the element.

The device may be arranged to monitor a thread which is displaced from time to time in being fed through said region. The means to receive light directed into said region may be arranged to receive light over a straight path through the region from the fiber optic element. The means responsive to the monitor signal changes may discriminate between the different changes in this signal when a thread tensioned in being fed and when an untensioned thread is displaced into or out of the straight light path to provide respective output signals. The device may also indicate the absence of a thread, such as occurs when the thread breaks. The device may include means responsive to the action of the machine to provide a timing signal at the time at which the thread is to be monitored. The device may include means responsive to the occurrence of the timing signal and to the occurrence of the output singal to indicate the nature of the thread feed at that time. The output signal may indicate that a thread tensioned in being fed has been displaced into the light path at that time.

The light from the source may be modulated. The light may be amplitude modulated to enhance the sensitivity of the means responsive to the monitor signal.

The device may be arranged to monitor the action of the looper thread feed in a sewing machine.

Embodiments of the invention will now be described with reference to the accompanying drawings in which.

Figure 1:
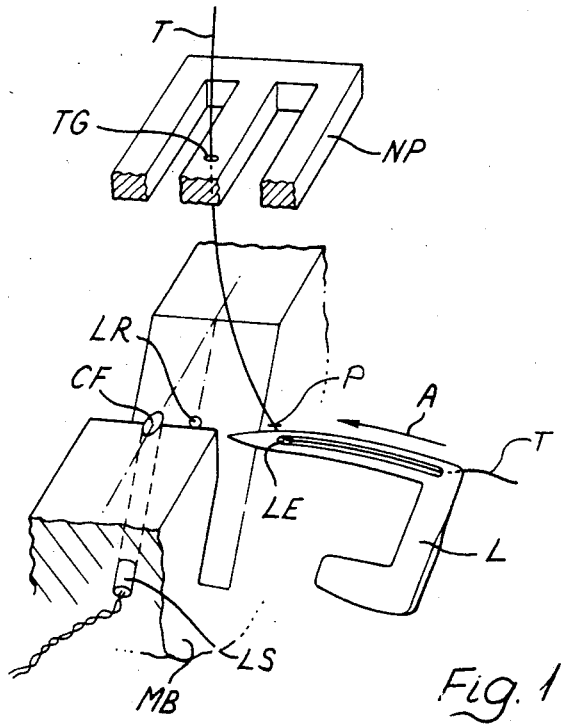
FIG. 1 shows in outline a thread monitor embodying the invention applied to a lower thread of a double lock chain stitch sewing machine.

In FIG. 1 the relevant parts of a conventional double lock chain stitch sewing machine are shown. The stitch is type 401 in BS 3870 PtI 1982. In one embodiment of the invention the machine is a 56300 Union Special machine although other machines can be fitted with an appropriate embodiment of the invention.

The needle plate is shown, in part, at NP and a looper at L. In use the looper moves in an arc, indicated by arrow A, to perform a stitch forming action in well-known manner, which it is not necessary to describe further. A mounting block for elements of the monitor device is indicated at MB. The region of the machine below the needle plate is extremely crowded and has several parts moving rapidly within it. Hithereto thread monitors have been kept away from this region because the crowding and the moving parts, as well as the presence of lint and other materials.

An important feature of the invention is the provision of a monitor device whose elements are compact and robust enough to be used in the region below the needle plate to monitor the thread at the point of use just above the eye of the looper as shown at P in FIGS. 1 and 2.

Mounting block MB is thus a body of material shaped to fit in this region without obstructing the action of the machine and support elements of the monitor adjacent the position of the thread as it passes from the looper to the needle plate at the outward extremity of the looper movement in the sense of arrow A; the position shown in the drawing.

Figure 2:
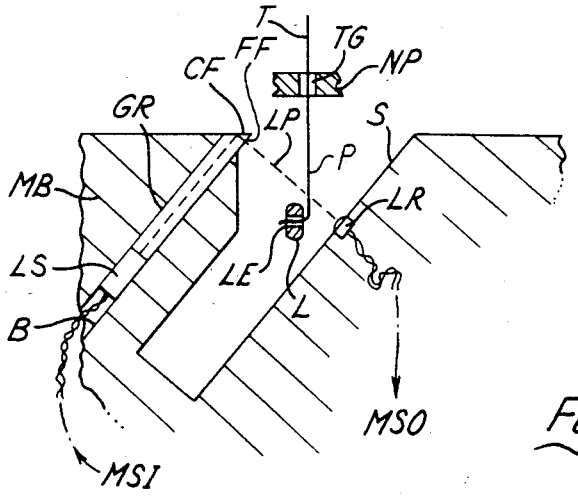
FIG. 2 shows a cross-sectional schematic view on the plane of the chain-dotted lines in FIG. 1.

Referring also to FIG. 2 of the mounting block MB in one embodiment is a block of plastics material such as nylon, provided with a slot S to receive the looper L. The slot is below the thread guide hole TG in the needle plate and is inclined to provide the best access for the looper L while retaining the strength of the block. A bore B is provided along an axis parallel to the inclination of slot S to emerge at the surface of the block and over the slot S, cut away as shown. The bore B receives a clad glass rod GR and a semi-conductor light source LS. The light source is arranged to send light along the rod GR, which is a fiber optic light path, to be incident on a cut face CF. This face is cut so that light in the rod is reflected out of the side of the rod along light path LP. The cut face also enables the rod GR to be easily positioned properly in the block MB with face CF flush with the surface of the block.

In this way the monitor device can project a beam of light in the best direction, substantially parallel to the needle plate plane, without having to be positioned parallel to the plane in the congested area. Focussing of the beam of light can be obtained by alteration of the curvature of the front face FF of the rod GR.

A semi-conductor light receiver LR is positioned opposite the rod GR in the line of light path LP to receive light from rod GR.

Source LS is energized by monitor signal input MSI and the receiver LR provides a monitor signal output MSO when light is incident on it.

Other means of conveying and directing the light may be used subject to the need for reliable operation and installation in a congested space.

It will be seen from FIGS. 1 and 2 that looper L swings through slots S to carry thread T in a stitch-forming action, as is well known. The position of the rod GR and receiver LR is carefully chosen so that light path LP is intercepted only by a correctly tensioned thread between looper L and guide TG when the looper is at or near its full outward travel. FIG. 2 shows this best.

The looper L is shown in cross-section at eye LE. The thread along the looper groove passes through the eye LE in a tensioned run to guide TG. The thread can only cut the light path LG when carried there by the looper.

In this way false indications are reduced. For example tension in the thread between the looper and the thread supply, not shown, is meaningless as a monitor input because the thread can break and tangle around the looper, or the take-up maintaining the tension. Thus only when the looper carries the eye LE to a particular position, which is adjustable but is typically ⅛" (3 mm) below the path LP and 3/16" (5 mm) beyond it, is the thread in position P to cut the path LP. Furthermore techniques using contact with the thread, e.g. micro-switches or rotating motion sensors, impart undue stress to the thread. Such stress can cause stitch distortion and contribute to seam weakness as the already stressed thread can not recover from the further stresses imposed during sewing.

Further discrimination is provided by the manner of handling the signals MSI and MSO.

In order to improve the discrimination of the monitor two arrangements are provided. Firstly the monitor is only active during the short interval of time when the thread should be crossing the light path LP. Secondly a particular form of signal from light receiver LR has been chosen as corresponding with the presence of a properly tensioned thread on light path LP.

Figure 3:
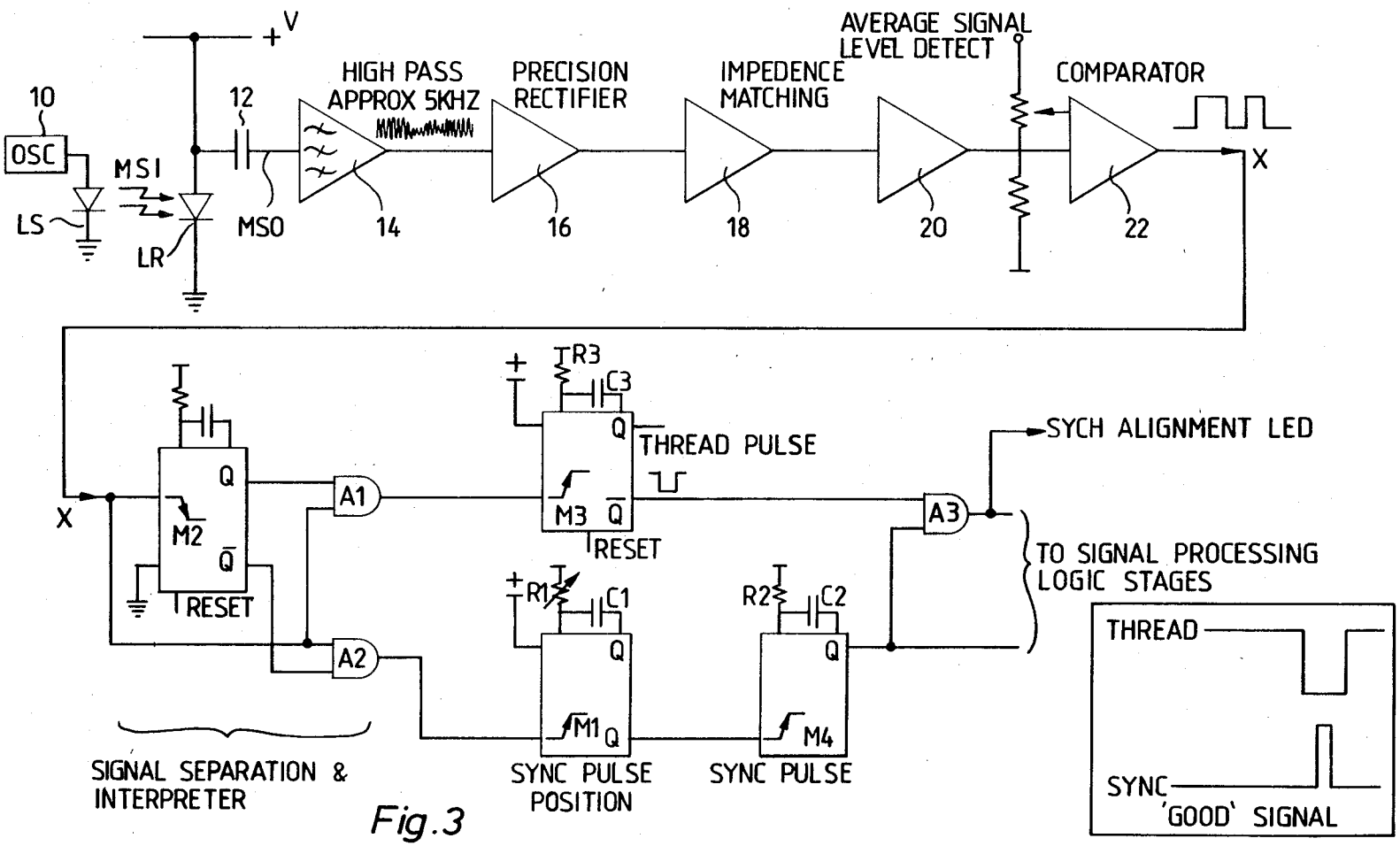
FIG. 3 shows in outline a schematic electronic circuit for the monitor in FIGS. 1 and 2.

With reference now to FIG. 3, an oscillator 10 (preferably 10 KHz) is used to drive the light source LS, preferably a light emitting diode LED, to produce the signal MSI which is supplied to the rod GR. The output signal MSO is generated by the detector LR which is preferably a photodiode. A blocking capacitor 12 is provided between the light receiver LR and a high pass filter 14. The high pass filter serves to block any signals below 5 KHz. The waveform emerging from the high pass filter is shown in FIG. 4*a* and is effectively the same as MSO but cleaner.

The waveform is then passed to a precision rectifier 16 which rectifies the signal to produce a D.C. voltage level signal which is passed through an impedance matching circuit 18 to an average signal level detector circuit 20. The impedance matching circuit 18 may be an amplifier with selected input and output impedances and the average level signal detector circuit 20 may be a capacitor charging circuit which averages the input signal and emphasizes the differing D.C. levels caused by the looper and thread.

Figure 4:
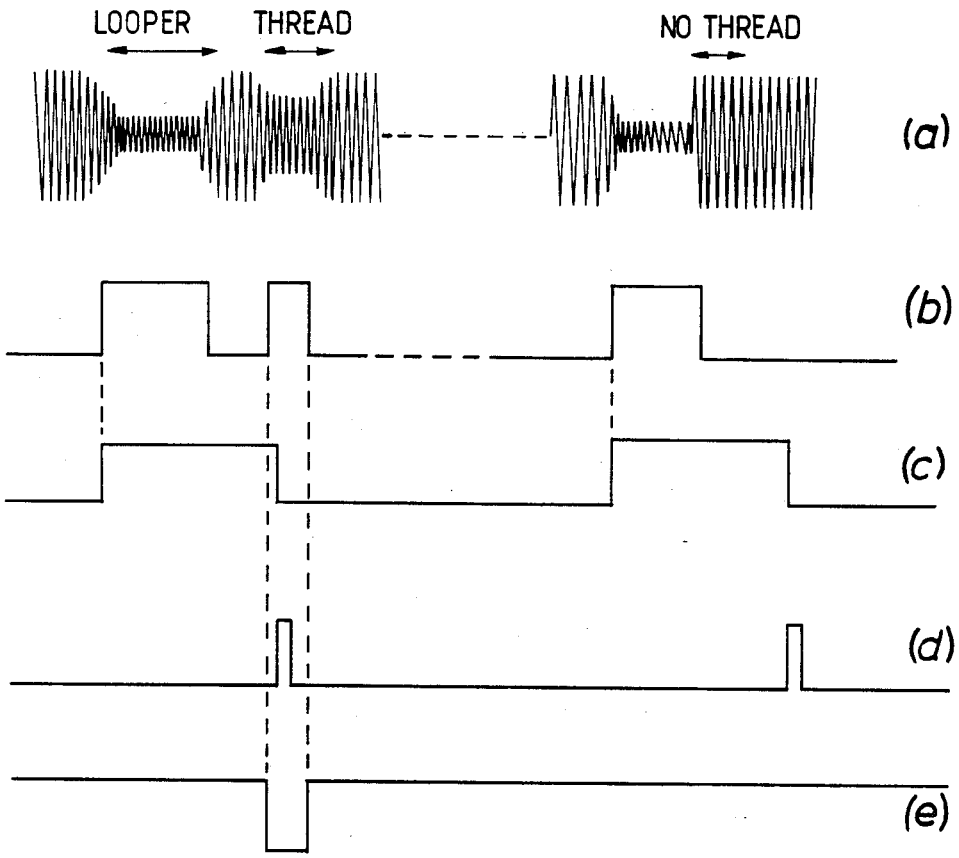
FIG. 4 shows timing diagrams associated with the circuit of FIG. 3.

The output of the average signal level detect circuit 20 is fed to a comparator 22 which is set to a predetermined voltage level to produce the output pulses as shown in FIG. 4*b*. Thus from the comparator 22 a clean D.C. level version of the signal MSO is obtained. This signal is fed to a signal separation and interpretation circuit comprising monostable M2 and AND gates A1, A2. This circuit is connected to two monostables M1 and M3, M1 determining the sync pulse position and M3 the thread pulse. Monostable M4 connected to M1 generates the narrow sync pulse and AND gate A3 connected to monostables M4 and M3 provides confirmation of a correct thread pulse. The circuit operates as follows with reference to FIGS. 4*a* to 4*e*.

The first rising edge of (a) is gated with the high Q output of monostable M2 to produce an output from AND gate A2 to trigger monostable M1. Monostable M1 the pulse width of which is adjustable via R1, C1 provides the pulse of waveform (C) the falling edge of which is used to generate the narrow sync pulse of waveform (d) the width of which is preset by choice of R2, C2.

On the first falling edge of waveform (b) monostable M2 is triggered causing Q to go high and enabling AND gate A1. When the rising edge of the thread pulse arrives monostable M3 is triggered and a negative going pulse is produced from the $\overline{Q}$ output as shown in FIG. 4*e*. This pulse is again of width set by R3 C3. Now, if the sync pulse occurs in the center of the inverted thread pulse (4*e*) AND gate A3 does not give any output because one or other of its inputs is low. If there is no thread pulse as shown in the second sequence, or if the thread and sync pulses are not co-terminus then an output pulse is generated by AND gate A3. Such a pulse can be fed to further logic processing stages and be used to stop the sewing action immediately or if desired the pulses from A3 can be fed to a counter which will stop the sewing action after a set number of pulses.

In the signal processing stages a simple counter can be employed to inhibit the operation of the thread detecting logic signal processing stages for a set number of rotations of the flywheel of the sewing machine. Pulses can be obtained from the flywheel by a light-detector system on an induction-magnet system both well known. This can be used to inhibit operation of the logic processing until after the initial start up acceleration of the sewing machine has been completed. This counter arrangement is easily configured as a count down resetable counter with a control output connected to a two input AND gate to which the output of A3 is connected. Until the counter, reset each time the sewing action is halted, has counted down to zero no pulses would pass through the AND gate.

One particular form of light conveying and directing means has been described here as this has proved very suitable. However the invention is not limited to this specific type of light conveying and directing means as other compact sources could be used in appropriate circumstances.

Suitable opto-electronic devices for the illustrated embodiment are Texas Instruments devices ITL24 GaAs Source and LS616 receiver. The clad glass rod Gr can be a piece of fibre optic material about 3 mm in diameter.

The rod forms a lens for the sideways radiated light so that the light can be concentrated at the yarn position to further improve the response of the monitor.

The fault indication can be arranged to stop the machine and provide other suitable actions for a particular operating requirement.

The monitoring arrangement has been described with reference to a particular monitoring requirement in a sewing machine but it will be understood that the technique is readily applied for precision monitoring of thread in other textile processes.

I claim:

1. A thread monitor device for a sewing machine to monitor looper thread feed under the bed of the sewing machine, the device including a source of light, means to convey the light to a specified area within the looper thread feed area, and to direct light into said area, means to receive light directed into said area from said source and means for producing a monitor signal representative of said received light, means responsive to said monitor signal and to changes therein to indicate the occurrence of a change in said signal representative of a change in thread feed in the area in which said means responsive to said monitor signal includes timing means coupled to the movement of the looper of the sewing machine to produce a timing window during which a signal is present if the looper thread is being correctly fed to the sewing machine.

2. A device according to claim 1, in which the means to convey and direct light is a fiber optic element having an inclined end face to direct light from the side of the element.

3. A device according to claim 2, in which the fiber optic element is shaped to focus light directed from the side of the element.

4. A device according to claim 1, in which the means to receive light directed into said region is arranged to receive light directed over a straight path through the region.

5. A device according to claim 1, in which the means responsive to the monitor signal changes discriminate between the different changes in this signal when a thread tensioned is being fed and when an untensioned thread is displaced into or out of the straight line path to prove respective output signals.

6. A device according to claim 1 to indicate the absence of a thread, such as occurs when the thread breaks.

7. A device according to claim 5, including means responsive to the occurrence of the timing window and to the occurrence of said output signal to indicate the nature of the thread feed at that time.

8. A device according to claim 7, in which a said output signal indicates that a thread tensioned in being fed has been displaced into the light path at that time.

9. A device according to claim 1, in which the light from the source is modulated.

10. A device according to claim 9, in which the light is amplitude modulated to enhance the sensitivity of the means responsive to the monitor signal.

* * * * *